US011758997B1

(12) United States Patent
Zheng et al.

(10) Patent No.: US 11,758,997 B1
(45) Date of Patent: Sep. 19, 2023

(54) APPLICATOR HEAD FOR APPLYING A COSMETIC PRODUCT

(71) Applicant: APR Beauty Group, Inc., Toronto (CA)

(72) Inventors: Min-Yan Zheng, Richmond Hill (CA); Feng-Ying Fu, Markham (CA); Jun Shen, Lighthouse point, FL (US)

(73) Assignee: APR Beauty Group, Inc., Toronto (CA)

( * ) Notice: Subject to any disclaimer, the term of this patent is extended or adjusted under 35 U.S.C. 154(b) by 0 days.

(21) Appl. No.: 17/837,438

(22) Filed: Jun. 10, 2022

(51) Int. Cl.
*A45D 34/04* (2006.01)
*A45D 40/26* (2006.01)

(52) U.S. Cl.
CPC ..... *A45D 34/043* (2013.01); *A45D 34/046* (2013.01); *A45D 34/045* (2013.01); *A45D 40/264* (2013.01); *A45D 40/265* (2013.01); *A45D 40/267* (2013.01)

(58) Field of Classification Search
CPC .. A45D 34/042; A45D 34/043; A45D 34/045; A45D 34/046; A45D 34/047; A45D 40/262; A45D 40/264; A45D 40/265; A45D 40/267; A45D 40/268
USPC ..... 401/121, 122, 126–130
See application file for complete search history.

(56) References Cited

U.S. PATENT DOCUMENTS

| | | | | |
|---|---|---|---|---|
| 6,280,112 | B1 * | 8/2001 | Vieu | A45D 34/042 401/122 |
| 11,185,145 | B1 * | 11/2021 | Zheng | A45D 33/00 |
| 11,523,672 | B2 * | 12/2022 | Bose | A46B 9/021 |
| 2008/0152419 | A1 | 6/2008 | Hartstock et al. | |
| 2017/0360185 | A1 | 12/2017 | De Bardonneche | |
| 2019/0350355 | A1 | 11/2019 | Liu | |

* cited by examiner

*Primary Examiner* — David J Walczak
(74) *Attorney, Agent, or Firm* — Jason Lee DeFrancesco

(57) ABSTRACT

An applicator head for applying a product including a cosmetic, care, or pharmaceutical product onto the keratinous substrate. The applicator head includes an applying member elongated along a longitudinal axis. The applying member includes an inclined distal end face and at least one sidewall extending from a proximal end of the applying member to a peripheral edge of the inclined distal end face. The at least one sidewall includes a front side face, a back side face, a left side face, and a right side face. An upper half portion of each of the back side face and the front side face is at least 20% narrower than an upper half portion of each of the left side face and the right side face. The at least one sidewall includes a central concave portion extending between a proximal portion and a distal portion of the at least one sidewall.

20 Claims, 7 Drawing Sheets

APPLICATOR HEAD FOR APPLYING A COSMETIC PRODUCT

BACKGROUND

Field

The present disclosure generally relates to an applicator head for applying a product including a cosmetic, care, or pharmaceutical product, onto a keratinous substrate such as skin, lips, under eyes, eyelids, cheeks, nails, or any other part of the body.

Description of the Related Art

Many cosmetic products that are flowable or otherwise non-self-sustaining in shape, are packaged and sold in a container that holds the cosmetic product and the cosmetic product is transported and applied from the container to a user's skin by a cosmetic applicator. Commonly, an applicator head is provided at the end of a stem carried by a cap which seats on and closes the mouth or opening of the container, the applicator head is immersed in the cosmetic material contained in the container when the cap is in the container-closing position. The cap serves as a handle for the user when the applicator head, bearing a quantity of the cosmetic product, is withdrawn from the container and applied to the skin.

Applicators for cosmetics or other substances, such as drugs, are known in various designs and forms. For example, reference is made to the US2008152419A1 and the US2017360185A1.

Certain applicator heads are configured to be mounted on a liquid reservoir or are connected in one piece to such a liquid reservoir. They allow liquid to be applied from the liquid reservoir. They usually have an opening through which the product is discharged out for application. For example, reference is made to the US20190350355.

Not all known applicator heads are suitable and designed to apply cosmetic products over both a large area and a narrow area, for example, to the skin.

Thus, there is a need for an applicator head that enables a user to conveniently apply a product to narrow areas as well as broad areas of the skin.

SUMMARY

It is an object of the present disclosure to provide a cosmetic package that can be easily configured to contain a product and an applicator head.

It is an object of the present disclosure to provide an applicator head that is suitable for a gentle application on both broad and narrow areas of a user's skin. It is yet another object of the present disclosure to provide an applicator head that offers a comparatively large surface area, very simple to use, economical to manufacture, and aesthetically pleasing.

Accordingly, there is provided an applicator head according to a first embodiment of the present disclosure. The applicator head comprises an applying member at its distal portion and a shank member at its proximal portion. The applying member of the applicator head is configured to apply the product including a cosmetic or care product. The applying member includes a distal end face and at least one sidewall extending from the proximal end of the applying member to a peripheral edge of the distal end face. The at least one sidewall of the applying member includes a proximal portion, a distal portion, and a concave central portion extending between the distal portion and the proximal portion. The proximal portion of the at least one sidewall of the applying member is configured to be substantially spherical or cylindrical. The distal portion of the at least one sidewall of the applying member has a flared oval shape.

The cosmetic or care product includes viscous cosmetics, mascara, eyebrow powder, lip gloss, hair color, skincare, under-eye cosmetics, pharmaceutical, and like products.

The applicator head and the applying member are elongated along a longitudinal axis. The applying member has a distal end and a proximal end that are opposite relative to the longitudinal axis and are separated, along said axis, by a distance. The distance is, for example, 12 mm and 20 mm, and preferably between 13 mm, or 16 mm.

The applicator head according to the first embodiment is configured to be part of a cosmetic package. The cosmetic package comprises a receptacle for holding a product and a cosmetic applicator. The cosmetic applicator comprises the applicator head, a stem, and a cap. The cap of the cosmetic applicator may have threads that can be screwed onto threads formed on the neck of the receptacle. The applicator head is retained at a distal end of the stem for applying the product; and the cap at a proximal end of the stem. Further, the distal end of the stem includes an interior longitudinal cavity for receiving and retaining the applicator head. More particularly, the shank member is configured to be received and retained within the longitudinal cavity of the stem. There may be provided a wiper in the neck of the receptacle for wiping off excess product from the cosmetic applicator.

In general, the use of the terms "distal" and "proximal" herein is supposed to mean that the distal is the end facing towards the bottom of the storage receptacle, whereas the proximal is the end facing towards the removal opening of the receptacle.

In the first embodiment, the shank member and the applying member are integral, however in alternate embodiments that may be two separate parts. The applying member is designed to apply the product to a target surface.

Further, the distal end face of the applying member is an inclined and convex surface. The distal end face has an oval or ellipse shape. According to an aspect of the present disclosure, the distal end face makes a non-zero angle with the longitudinal axis of the applicator head. Preferably, the distal end face makes an acute angle with the longitudinal axis of the applying member. Preferably, this acute angle is in the range between 30° and 75°, ideally in the range between 50° and 70°.

According to an aspect of the present disclosure, the distal end face is available for use as a free, unhindered surface that can be entirely brought into contact with the part of the skin to be treated for the application of the cosmetic. The distal end face is ideally flocked. A flocked surface can store significantly more product than a smooth plastic surface. For particular applications, though, it can also be embodied as an unflocked application-ready plastic surface. The distal end face extends along at least 20% of the length of the applying member and at most 40% of the length of the applying member.

According to another aspect of the present disclosure, the transverse cross-section of the applying member varies along the length direction. The applying member has non-circular and rounded transverse cross-sections along a major portion of its length. More particularly, applying member has non-circular and rounded transverse cross-sections along the distal portion and the concave central portion of the at least one sidewall. Each of the transverse cross-sections of the applying member at the distal portion and the concave central portion is rounded and has a major axis and a minor axis, and wherein the major axis and the minor axis vary along the length of the applying member. The length of the major axis of the transverse cross-sections increases gradually from the mid-length of the applying member towards the distal end face of the applying member. A transverse cross-section of the applying member at the distal portion of the at least one sidewall is an ellipse in shape. A transverse cross-section of the applying member at the concave central portion of the at least one sidewall is oval. A transverse cross-section of the applying member at the proximal portion of the at least one sidewall is substantially circular.

In a preferred embodiment, the proximal portion of the at least one sidewall of the applying member has rounded cross-sections that are substantially circular. The distal portion, the concave central portion, and the distal end face of the applying member have rounded cross-sections that are oval or elliptical. The applying member is thus not rotationally symmetric, meaning that the applying member is flattened, particularly the distal portion, the concave central portion of the at least one sidewall are flattened.

The term "substantially circular" is used herein to describe the circular or nearly circular shape.

According to yet another aspect of the present disclosure, the at least one sidewall of the applying member includes a convexly curved surface followed by a concavely curved surface when seen along the proximal end to the distal end of the applying member. The at least one sidewall of the applying member defines at least four curved faces around the longitudinal axis of the applying member. The four curved faces of the at least one sidewall include a front side face, a back side face, a left side face, and a right side face. Each of the front side face, the back side face, the left side face, and the right side face include a convexly curved surface followed by a concavely curved surface when the applying member is seen along the proximal end to the distal end thereof. In other words, each of the front side face, the back side face, the left side face, and the right side face follow substantially the same curves along the longitudinal axis of the applying member.

According to yet another aspect of the present disclosure, the left side face and the right side face are symmetrical relative to a mid-plane comprising the longitudinal axis of the applying member.

According to yet another aspect of the present disclosure, the distal end face of the applying member is inclined towards the front side face.

According to yet another aspect of the present disclosure, the concavely curved surface of the at least one sidewall of the applying member has an extremum depth defined on the outer surface at about half a length of the applying member at the concave central portion of the at least one sidewall. This concavely curved surface has the extremum depth between the distal and proximal ends and preferably is substantially equidistant from said distal and proximal ends of the applying member. The width of each of the four curved faces of the at least one sidewall first increases from the proximal end of the applying member and then decreases towards the mid-length of the applying member before increasing gradually towards the distal end of the applying member.

According to a preferred embodiment, the convexly curved surface of the at least one sidewall defines a rounded convex surface at the proximal portion of the applying member adjacent to the proximal end of the applying member. The convexly curved surface of the at least one sidewall of the applying member defines an extremum at substantially about one-fourth of the length of the applying member at the proximal portion of the at least one sidewall.

The applying member may have a chamfered region between the at least one sidewall and the distal end face. The height of this chamfer will be less than 3 mm.

According to yet another aspect of the present disclosure, the left side face and the right side face have the same shape as each other or similar shape to each other.

Furthermore, according to a preferred embodiment, each of the front side face, the back side face, the left side face, and the right side face has a varying width in the longitudinal direction of the applying member. An upper half portion of each of the back side face and the front side face is at least 20% narrower than an upper half portion of each of the left side face and the right side face. More particularly, the distal portion and the concave central portion of each of the back side face and the front side face are at least 20% narrower than the distal portion and the concave central portion of each of the left side face and the right side face.

The maximum width of each of the front side face and the back side face is defined at the proximal portion of the at least one sidewall of the applying member on the extremum of the convexly curved surface about one-fourth of the length of the applying member. The maximum width of each of the left-side face and the right-side face is defined at the distal portion of the at least one sidewall that is spaced from the distal end of the applying member. The maximum width of each of the front-side face and the back-side face is slightly less than the maximum width of each of the left-side face and the right-side face. The maximum width of each of the front side face and the back side face is between 5-7 mm. The maximum width of each of the left side face and the right-side face is between 5-8 mm.

The width of the distal portion at each of the left side face and the right side face is 30% more than the corresponding width of the distal portion at each of the front side face and the back side face.

According to a preferred embodiment, the minimum width of each of the four curved faces is defined at the concave central portion of the at least one sidewall. The minimum width of each of the front side face and the back side face is less than the minimum width of each of the left side face and the right side face. More particularly, the minimum width of each of the front side face and the back side face is at least 30% less than the minimum width of each of the left side face and the right side face. The minimum width of the front side face and the back side face is preferably between 3-5 mm. The minimum width of the left side face and the right side face is preferably between 5-6 mm.

According to a preferred embodiment, the maximum width of the proximal portion of the at least one sidewall on the front side face may be substantially larger or equal to the maximum width of the distal portion of the at least one sidewall on the front side face.

According to a preferred embodiment, the width of the rounded convex surface at the proximal portion of the at least one sidewall of the applying member may be substantially the same on all the four curved faces of the at least one sidewall.

According to yet another aspect of the present disclosure, the front side face has a height less than the height of the back side face. The height of the front side face is at least 60% of the height of the back side face, preferably front side face is about 70% of the height of the back side face. In an embodiment, the height of the back side face is between 13-16 mm. A length of the distal portion at the front side face is at least 50% less than the length of the distal portion at the back side face.

According to yet another aspect of the present disclosure, the concavely curved surface of the front side face has a first radius of curvature and the concavely curved surface of the back side face has a second radius of curvature and wherein the first radius of curvature is shorter than the second radius of curvature.

According to a preferred embodiment, the distal end face of the applying member has maximum width between 5-7 mm and a length preferably between 7-10 mm. The distal end face has a consistently continuous curve, i.e. the distal end face is not flat, but instead protrudes outward in a convex fashion. The distal end face has narrower dimensions than that of the four curved faces, thus also allowing for a more accurate application and contour lining. A surface area of the distal end face is at least 10% smaller than a surface area of the front side face and at least 20% smaller than the surface area of each of the backside face, the left side face, and the right side face.

According to a preferred embodiment, the at least one sidewall of the applying member flares outwards towards the distal end thereof. Because of flaring, a distal endpoint of the front side face is furthest away from the longitudinal axis on the front side face. Another distal endpoint on the back side face is furthest away from the longitudinal axis on the back side face.

The applying member is not rotationally symmetric as that the applying member is flattened having transverse cross-sections with a major and a minor axis. The front side face and back side face are to be used to precisely apply the cosmetic, while the left and the right side faces may be used for blending.

According to an embodiment of the present disclosure, an outer surface of the applying member may be covered with fibers. In an alternate embodiment of the present disclosure, the applying member may or may not be flocked or partially flocked. Further, the applying member is made of a flexible material, in particular plastic material. More particularly, the applying member is made of an elastomer, in particular a thermoplastic elastomer.

An applicator head according to a second embodiment includes an applying member having at least one orifice designed to dispense a cosmetic product. The applicator head is configured to be part of a cosmetic package and is mounted on an opening of a receptacle of the cosmetic package. Further, the applicator head comprises an internal product delivery passageway that terminates in at least one orifice on a distal end face of the applying member. The applying member of the second embodiment differs from the applying member of the first embodiment in terms of size and dimensions.

The applying member according to the second embodiment includes at least one sidewall. The at least one sidewall of the applying member includes a proximal portion, a distal portion, and a concave central portion extending between the distal portion and the proximal portion. The proximal portion of the at least one sidewall of the applying member is substantially cylindrical. The distal portion of the at least one sidewall of the applying member has a flared oval shape. The transverse cross-section of the concave central portion is oval or elliptical. The applying member is thus not rotationally symmetric, meaning that the applying member is flattened, particularly the distal portion and the concave central portion are flattened.

According to an aspect of the second embodiment, the at least one sidewall includes a front side face, a back side face, a left side face, and a right side face. The maximum width of each of the front side face, the back side face, the left side face, and the right-side face is defined at the proximal portion of the at least one sidewall. The maximum width of each of the front side face and the back side face is substantially equal to or less than the maximum width of each of the left side face and the right-side face. The maximum width of each of the front side face, the back side face, the left side face, and the right-side face is between 9 mm to 11 mm.

According to another aspect of the second embodiment, the minimum width of each of the front side face, the back side face, the left side face, and the right-side face is defined at the concave central portion of the at least one sidewall. More particularly, the minimum width of each of the front side face and the back side face is at least 20% less than the minimum width of each of the left side face and the right side face. The minimum width of the front side face and the back side face is preferably between 5-8 mm.

According to another aspect of the second embodiment, the height of the front side face is at least 60% of the height of the back side face. In the exemplary embodiment, the height of the back side face is between 15-17 mm.

According to another aspect of the second embodiment, the distal end face is inclined towards the front side face. The distal end face of the applying member has an elliptical shape.

Furthermore, the applying member of the applicator head according to the second embodiment may have an outer surface flocked with fibers.

According to yet another aspect of the second embodiment, the applicator head includes a shank member which connects the applying member to the receptacle. The shank member of the applicator head may be secured to the receptacle by, for example, a press-fit, snap-fit, adhesive, and/or engagement by one or more engagement features.

According to yet another aspect of the second embodiment, the cosmetic package includes a cap to cover the applicator head and protect it from the external atmosphere. The cap may include a pin that extends from an inner surface of the top of the cap and is inserted in the orifice of the applicator head to seal to the orifice.

According to an embodiment of the present disclosure, at least a part and preferably all of the applicator head can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

In the first embodiment, the wiper serves to wipe off not only the excess cosmetic product attached to the applying member but also the cosmetic product attached to the stem.

According to the first embodiment, the receptacles, and the caps, may be made of a rigid material like glass, metal, hard plastic, or any other material known in the art. However, in alternate embodiments, the receptacles, and the cap, may be made of a flexible material like flexible polymeric material or any other material known in the art.

According to an embodiment of the present disclosure, the applicator head can be made, at least in part, from a material that is more flexible than the material from which the stem is made.

According to the first embodiment of the present disclosure, the applicator head and the stem are fitted together by a snap fitment. However, in alternate embodiments, the applicator head and the stem may be fit together by friction fit, gluing, crimping, magnetic engagement, and the like.

According to the first embodiment of the present disclosure, the stem can have a longitudinal axis that is rectilinear as shown. However, in alternate embodiments, it could be curved.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
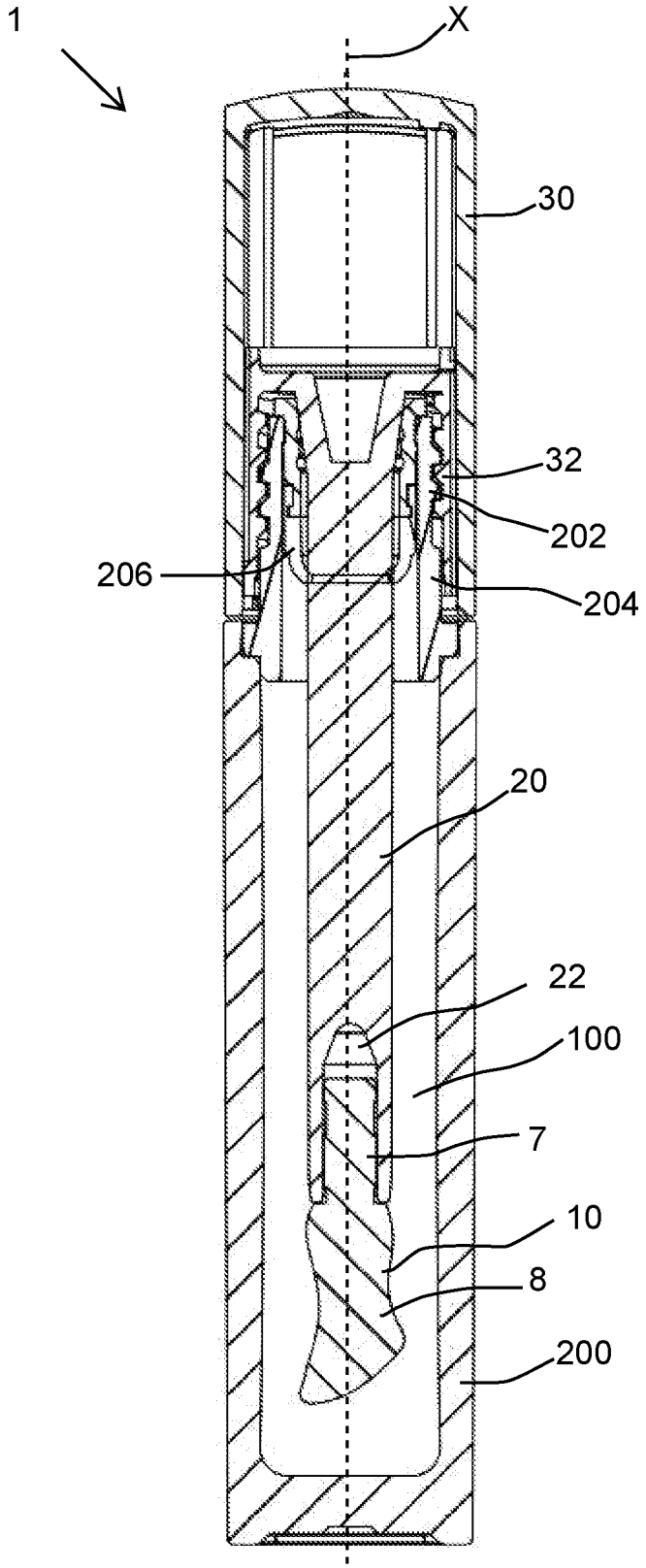
FIG. 1 illustrates a longitudinal cross-sectional view of a cosmetic package equipped with a cosmetic applicator according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

Throughout this specification, the terms "comprise," "comprises," "comprising" and the like, shall consistently mean that a collection of objects is not limited to those objects specifically recited.

FIG. 1 illustrates a longitudinal sectional view of a cosmetic package 1. The cosmetic package 1 comprises a receptacle 200 for holding a product (not shown) and a cosmetic applicator 100. The cosmetic applicator 100 comprises an applicator head 10, a stem 20, and a cap 30, see FIG. 2. The cap 30 of the cosmetic applicator 100 has threads 32 that can be screwed onto threads 202, formed on a neck 204 of the receptacle 200. The applicator head 10 is retained at a distal end of the stem 20 for applying the product; and the cap 30 at a proximal end of the stem 20.

In general, the use of the terms "distal" and "proximal" herein is supposed to mean that the distal is the end facing towards the inside of the storage receptacle 200, whereas the proximal is the end facing towards the removal opening of the receptacle 200.

As seen in FIG. 1, the distal end of the stem 20 includes an interior longitudinal cavity 22 for receiving and retaining the applicator head 10. Inserted in the neck 204 of the receptacle 200 is a wiper 206 for wiping off excess product from the cosmetic applicator 100.

Further, the applicator head 10 of cosmetic applicator 100 may be used to apply the product including a cosmetic or care product. The cosmetic or care product includes viscous cosmetics, mascara, eyebrow powder, lip gloss, hair color, skincare, under-eye cosmetics, pharmaceutical, and like products.

Figure 3:
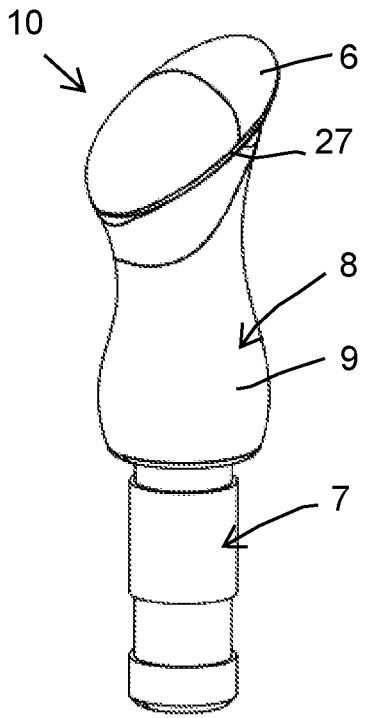
FIG. 3 illustrates a perspective view of an applicator head of the cosmetic applicator of FIG. 2.
Figure 4:
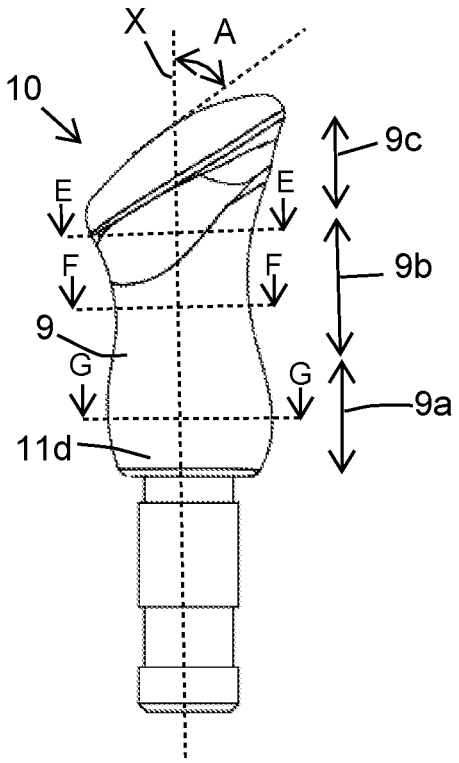
FIG. 4 illustrates a right side view of the applicator head of FIG. 3.
Figure 5:
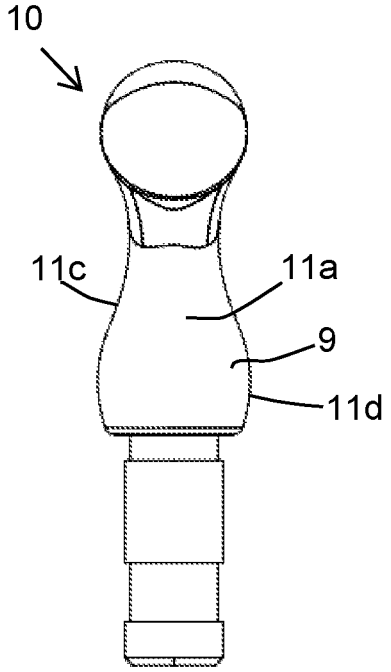
FIG. 5 illustrates a front view of the applicator head of FIG. 3.

As shown in FIGS. 3-5, the applicator head 10 comprises an applying member 8 at its distal portion and a shank member 7 at its proximal portion. The shank member 7 is configured to be received and retained within the longitudinal cavity 22 of the stem 20 (see FIG. 1).

In the present embodiment, the shank member 7 and the applying member 8 are integral, however in alternate embodiments that may be two separate parts. The applying member 8 is designed to apply the product to a target surface.

The applicator head 10 and the applying member 8 are elongated along a central longitudinal axis X of the cosmetic applicator 100 (refer to FIG. 1). The applying member 8 has a distal end 3 and a proximal end 4 that are opposite relative to the axis X and are separated, along said axis X, by a distance marked L in FIG. 2. Said distance L is, for example, between 12 mm and 20 mm, and preferably between 13 mm, or 16 mm.

The applying member 8 includes a distal end face 6 and at least one sidewall 9 extending from the proximal end 4 of the applying member 8 to a peripheral edge of the distal end face 6. As illustrated in FIG. 4, the at least one sidewall 9 of the applying member 8 includes a proximal portion 9*a*, a distal portion 9*c*, and a concave central portion 9*b* extending between the distal portion 9*a* and the proximal portion 9*c*. The proximal portion 9*a* of the at least one sidewall 9 of the applying member 8 can be substantially spherical or cylindrical. The distal portion 9*c* of the at least one sidewall 9 of the applying member 8 has a flared oval shape.

Further, the distal end face 6 is an inclined and convex surface. The distal end face 6 has an oval or ellipse shape, as illustrated in FIGS. 3-4. According to an aspect of the present disclosure, the distal end face 6 makes an angle A with the longitudinal axis X. Preferably, the distal end face 6 makes an acute angle A with the longitudinal axis X of the applying member 8. Preferably, this acute angle A is in the range between 30° and 75°, ideally in the range between 50° and 70°.

According to an aspect of the present disclosure, the distal end face 6 is available for use as a free, unhindered surface that can be entirely brought into contact with the part of the skin to be treated for the application of the cosmetic. The distal end face 6 is ideally flocked which is not graphically depicted here. A flocked surface can store significantly more product than a smooth plastic surface. For particular applications, though, it can also be embodied as an unflocked application-ready plastic surface.

Figure 9:
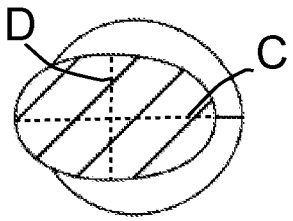
FIG. 9 illustrates a transverse cross-sectional view of the applicator head of FIG. 4, taken along line E-E.
Figure 10:
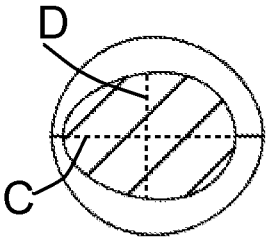
FIG. 10 illustrates a transverse cross-sectional view of the applicator head of FIG. 4, taken along line F-F.
Figure 11:
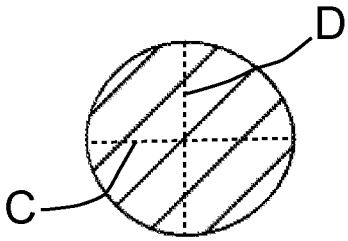
FIG. 11 illustrates a transverse cross-sectional view of the applicator head of FIG. 4, taken along line G-G.

The transverse cross-section of the applying member 8 varies along the length direction. The applying member 8 has a non-circular and rounded transverse cross-section along a major portion of its length. More particularly, applying member 8 has non-circular and rounded transverse cross-sections along the distal portion 9*c* and the concave central portion 9*b* of the at least one sidewall 9, as illustrated in FIGS. 9 and 10. Each of the transverse cross-sections of the applying member 8 at the distal portion 9*c* and the concave central portion 9*b* is rounded and has a major axis C and a minor axis D, and wherein the major axis C and the minor axis D of the various cross-sections vary. The length of the major axis C of the transverse cross-sections increases gradually from a mid-length of the applying member 8 towards the distal end face 6 of the applying member 8. FIG. 9 shows a transverse cross-section of the applying member 8 at the distal portion 9*c* which is an ellipse in shape. FIG. 10 shows a transverse cross-section of the applying member 8 at the concave central portion 9*b* which is oval. FIG. 11 shows a transverse cross-section of the applying member 8 at the proximal portion 9*a* that is substantially circular.

In the exemplary embodiment, the proximal portion 9*a* of the applying member 8 has rounded cross-sections that are substantially circular. The distal portion 9*c*, the concave central portion 9*b*, and the distal end face 6 of the applying member 8 have rounded cross-sections that are oval or elliptical. The applying member 8 is thus not rotationally symmetric, meaning that the applying member 8 is flattened, particularly the distal portion 9*c*, the concave central portion 9*b* are flattened.

Figure 6:
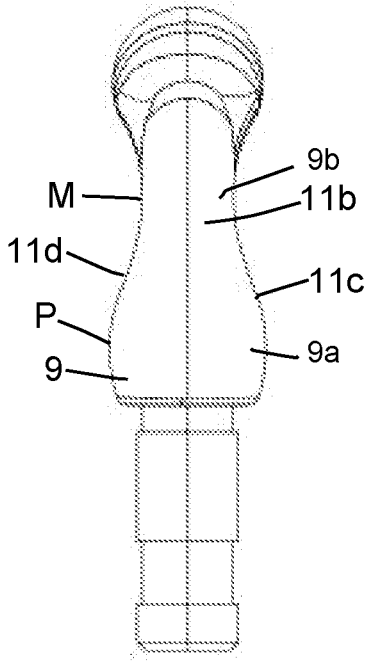
FIG. 6 illustrates a back view of the applicator head of FIG. 3.

The at least one sidewall 9 of the applying member 8 includes a convexly curved surface followed by a concavely curved surface when seen along the proximal end 3 to the distal end 4 of the applying member 8, as seen in FIGS. 3-6. The at least one sidewall 9 of the applying member 8 defines at least four curved faces around the longitudinal axis X. The four curved faces of the at least one sidewall 9 include a front side face 11*a*, a back side face 11*b*, a left side face 11*c*, and a right side face 11*d*. Each of the front side face 11*a*, the back side face 11*b*, the left side face 11*c*, and the right side face 11*d* includes a convexly curved surface followed by a concavely curved surface when seen along the proximal end 3 to the distal end 4 of the applying member 8. In other words, each of the front side face 11*a*, the back side face 11*b*, the left side face 11*c* and the right side face 11*d* follow substantially the same curves along the longitudinal axis X (see FIGS. 3-5). The left side face 11*c* and the right side face 11*d* are symmetrical relative to a mid-plane comprising the longitudinal axis X, as seen in FIGS. 5 and 6. The distal end face 6 is inclined towards the front side face 11*a*.

Figure 2:
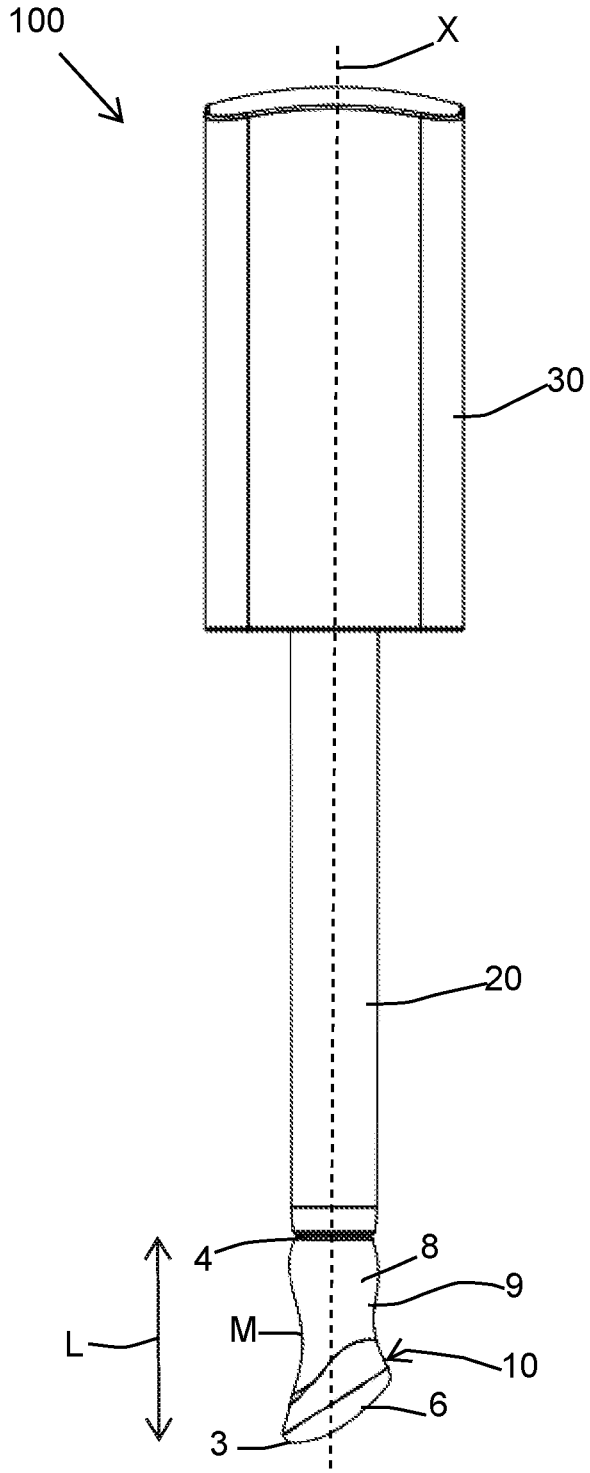
FIG. 2 illustrates a front view of the cosmetic applicator of the cosmetic package of FIG. 1.

Referring FIGS. 2, and 6, the concavely curved surface of the at least one sidewall 9 of the applying member 8 has an extremum depth M defined on the outer surface at about half a length L of the applying member 8 at the concave central portion 9*b*. This concavely curved surface has the extremum depth M between the distal 4 and proximal 3 ends and preferably is substantially equidistant from said distal and proximal ends 3, 4. The width of each of the four curved faces 11*a*, 11*b*, 11*c*, and 11*d* of the at least one sidewall 9 first increases, from the proximal end 4 of the applying member 8, then decreases towards the mid-length of the applying member 8 before increasing gradually towards the distal end 3 of the applying member 8, as seen in FIGS. 3-6.

The convexly curved surface of the at least one sidewall 9 defines a rounded convex surface at the proximal portion 9*a* of the applying member 8 adjacent to the proximal end 4. The convexly curved surface of the at least one sidewall 9 of the applying member 8 defines an extremum P at substantially about one-fourth of the length L of the applying member 8 at the proximal portion 9*a*, refer FIG. 6.

The applying member 8 may have a chamfered region between the at least one sidewall 9 and the distal end face 6. The height of this chamfer 27 will be less than 3 mm.

The left side face 11*c* and the right side face 11*d* have the same shape as each other or similar shape to each other, as shown in FIGS. 5 and 6. Each of the front side face 11*a*, the back side face 11*b*, the left side face 11*c*, and the right side face 11*d* has a varying width in the longitudinal direction of the applying member 8, as seen in FIGS. 3-6. An upper half portion of each of the back side face 11*b* and the front side face 11*a* is at least 20% narrower than an upper half portion of each of the left side face 11*c* and the right side face 11*d*. More particularly, the distal portion 9*c* and the concave central portion 9*b* of each of the back side face 11*b* and the front side face 11*a* are at least 20% narrower than the distal portion 9*c* and the concave central portion 9*b* of each of the left side face 11*c* and the right side face 11*d*.

The maximum width W1 of each of the front side face 11*a* and the back side face 11*b* is defined at the proximal portion 9*a* of the applying member 8 on the extremum P of the convexly curved surface about one-fourth of the length L of the applying member 8. The maximum width W2 of each of the left side face 11*c* and the right-side face 11*d* is defined at the distal portion 9*c* of the at least one sidewall 9 that is spaced from the distal end 3 of the applying member 8. The maximum width W1 of each of the front side face 11*a* and the back side face 11*b* is slightly less than the maximum width W2 of each of the left side face 9*c* and the right-side face 9*d*. The maximum width W1 of each of the front side face 9*a* and the back side face 9*b* is between 5-7 mm. The maximum width W2 of each of the left side face 9*c* and the right-side face 9*d* is between 5-8 mm.

Figure 7:
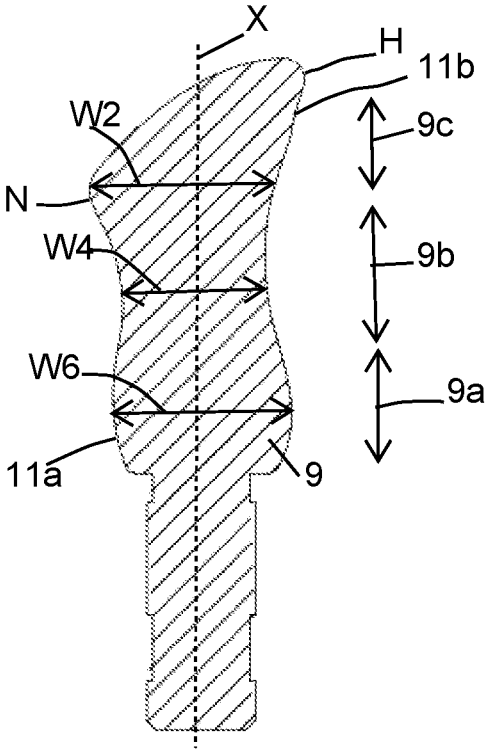
FIG. 7 illustrates a longitudinal cross-sectional view of the applicator head of FIG. 3.
Figure 8:
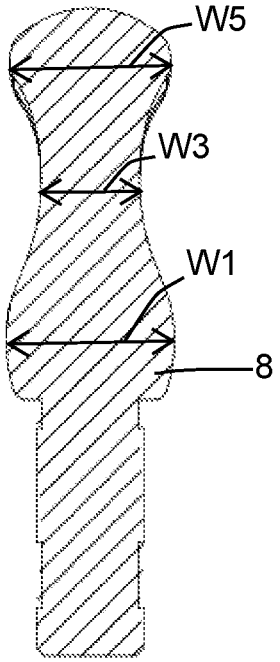
FIG. 8 illustrates another longitudinal cross-sectional view of the applicator head of FIG. 3.

Referring to FIGS. 7 and 8, the minimum width of each of the four curved faces 11*a*, 11*b*, 11*c*, and 11*d* are defined at the concave central portion 9*b* of the at least one sidewall 9. The minimum width W3 of each of the front side face 9*a* and the back side face 9*b* is lesser than the minimum width W4 of each of the left side face 9*c* and the right side face 9*d*. More particularly, the minimum width W3 of each of the front side face 9*a* and the back side face 9*b* is at least 30% less than the minimum width W4 of each of the left side face 9*c* and the right side face 9*d*. The minimum width of the front side face 9*a* and the back side face 9*b* is preferably between 3-5 mm. The minimum width of the left side face 9*c* and the right side face 9*d* is preferably between 5-6 mm.

On the front side face 11*a*, the width W3 of the applying member 8 at the concave central portion 9*b* is smaller than the maximum width W1 at the proximal portion 9*a* and a maximum width W5 of the distal portion 9*c* on the front side face 11*a*. Further, the maximum width W3 of the proximal portion W3 on the front side face 11*a* may be substantially larger or equal to the maximum width W5 of the distal portion 9*c* of the applying member 8 on the front side face.

Further, the width W1, W6 of the rounded convex surface at the proximal portion 9*b* of the applying member 8 may be substantially the same on all the four curved faces 11*a*, 11*b*, 11*c*, 11*d* of the at least one sidewall 9.

The front side face 9*a* has a height less than the height of the back side face 9*b*, as seen in FIGS. 2 and 4. The height of the front side face 11*a* is at least 60% of the height of the back side face 9*a*, preferably it is about 70% of the height of the back side face 11*b*. In the exemplary embodiment, the height of the back side face 11*b* is between 13-16 mm. Furthermore, as seen in FIGS. 4 and 7, the length of the distal portion at the front side face 11*a* is at least 60% less than the length of the distal portion at the back side face 11*b*.

The concavely curved surface of the front side face 11*a* has a first radius of curvature and the concavely curved surface of the back side face 11*b* has a second radius of curvature and wherein the first radius of curvature is shorter than the second radius of curvature.

Figure 12:
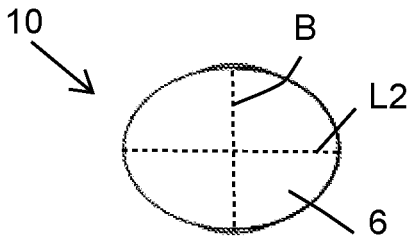
FIG. 12 illustrates a top view of the applicator head of FIG. 3.

Referring to FIG. 12, the distal end face 6 of the applying member 8 has a maximum width B between 5-7 mm and a length L2 preferably between 7-10 mm. The distal end face 6 has a consistently continuous curve, i.e. the distal end face 6 is not flat, but instead protrudes outward in a convex fashion. The embodiment shown in FIGS. 4 and 5 has the distal end face 6 has narrower dimensions than that of the four curved faces, thus also allowing for a more accurate application and contour lining. A surface area of the distal end face is at least 10% smaller than a surface area of the front side face and at least 20% smaller than the surface area of each of the backside face, the left side face, and the right side face.

Referring back to in FIG. 7, the at least one sidewall 9 of the applying member 8 flares outwards towards the distal end thereof. Because of flaring, a distal endpoint N of the front side face 11*a* is furthest away from the longitudinal axis X on the front side face 11*a*. Another distal endpoint H on the back side face 11*b* is furthest away from the longitudinal axis X on the back side face 11*b*.

Thus, when removing the applying member from the receptacle 200 containing the cosmetic product and through the wiper 204, the amount of cosmetic adhering to the concave central portion 9*b* substantially remains there. It is applied on the skin by moving the applying member 8 along the skin, its central longitudinal axis X being substantially perpendicular to the longitudinal direction of the skin. The distal end face 6 of the applying member 8 may serve to locally spread the cosmetic, if necessary, or to outline a contour.

The applying member 8 is not rotationally symmetric, as illustrated in particular in FIGS. 9-11, meaning that the applying member 8 is flattened, with this front side face 11*a*, back side face 11*b* to be used to precisely apply the cosmetic, while the left and the right side faces 11*c*, 11*d* may be used for blending. The applying member 8 is elongated, that is to say, its extent in a direction parallel to the longitudinal axis X is larger than its largest extension perpendicularly to the longitudinal axis X. Particularly, the largest extension of the applying member 8 in the direction parallel to the longitudinal axis X by at least a factor of 1.5, more preferably is greater by at least a factor of 2 than the greatest extension of the applying member 8 in a direction perpendicular to the longitudinal axis X.

Figure 13:
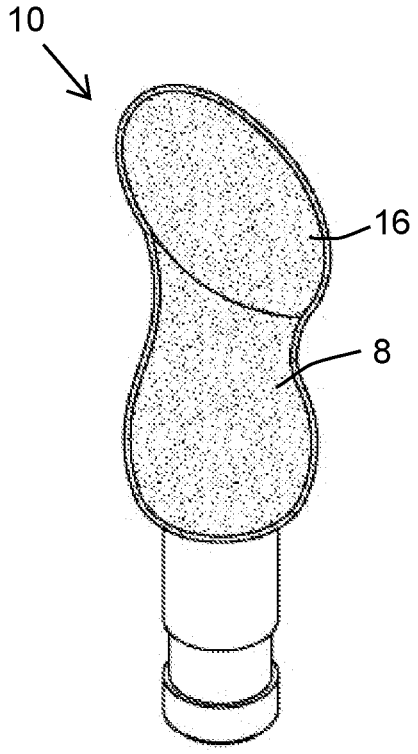
FIG. 13 illustrates another perspective view of an applicator head of FIG. 3 with flocking on an outer surface of an applying member thereof.

According to an embodiment of the present disclosure, an outer surface of the applying member 8 may be covered with an application element 16 which in this case is flocked fibers, see FIG. 13. Briefly, the fibers for flocking which may be of any commonly used material, such as nylon, polyester, or any natural fiber are applied with an adhesive, such as an epoxy, to the surface to be flocked. The flocking finish to the outer surface of the applying member 8 may be achieved by an appropriately chosen known technique, such as electrostatic flocking.

According to an alternate embodiment of the present disclosure, the applying member 8 may or may not be flocked or partially flocked.

In the present example, the applying member 8 is made of a flexible material, in particular plastic material. More particularly, the applying member 8 is made of an elastomer, in particular a thermoplastic elastomer.

Figure 14:
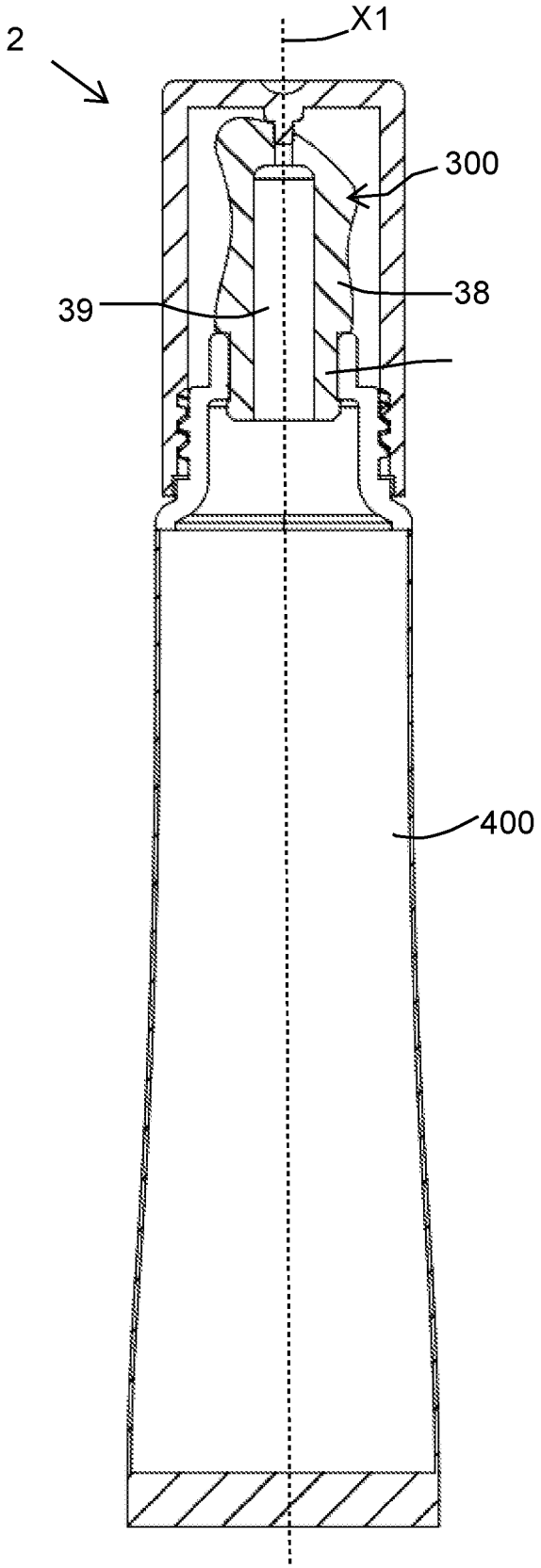
FIG. 14 a longitudinal cross-sectional view of a cosmetic package equipped with an applicator head according to a second embodiment of the present disclosure.

FIGS. 14-20 shows applicator head 300 with an applying member 38 according to a second embodiment of the present disclosure. The applying member 38 is different from the applying member 8 of the first embodiment, as the applying member 38 has at least one orifice 37 (see FIG. 15) designed to dispense a cosmetic product. The applicator head 300 is configured to be part of a cosmetic package 2 as shown in FIG. 14 and is mounted on an opening of a receptacle 400. Further, the applicator head 2 comprises an internal product delivery passageway 39 that terminates in at least one orifice 37 on a distal end face 66 of the applying member 38. The at least one orifice 37 is positioned along a central longitudinal axis X1 of the applicator head 300 for dispensing the cosmetic product, refer to FIG. 16.

The applying member 18 also differs from the applying member 8 of the first embodiment in terms of size and dimensions.

Figure 17:
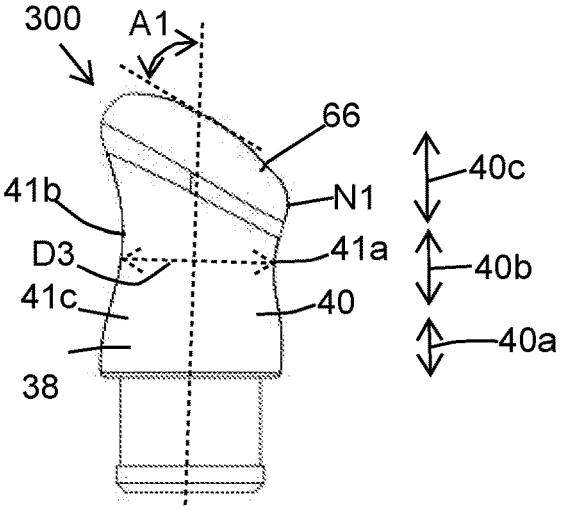
FIG. 17 illustrates a left side view of the applicator head of FIG. 15.

Further, as shown in FIG. 17, the distal end face 66 of the applying member 38 makes a non-zero angle A1 with central longitudinal axis X1 of the applicator head 300. This design facilitates the application of the product to the user's skin. In various implementations, the angle A1 may be between about 35° and about 75°. Still, further implementations may have angles anywhere from 5° to 90°.

Figure 15:
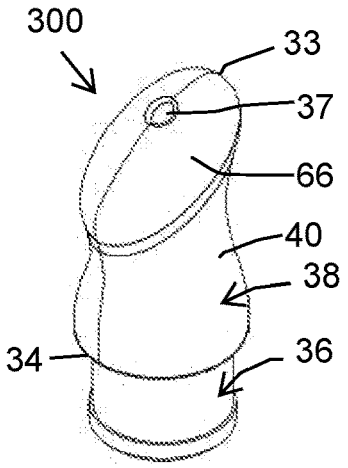
FIG. 15 illustrates a perspective view of the applicator head of FIG. 14.

As shown in FIG. 15, the applying member 38 includes at least one sidewall 40. Referring to FIG. 17, the at least one sidewall 40 of the applying member 38 includes a proximal portion 40*a*, a distal portion 40*c*, and a concave central portion 40*b* extending between the distal portion 40*a* and the proximal portion 40*c*. The proximal portion 40*a* of the at least one sidewall 40 of the applying member 38 can be substantially cylindrical. The distal portion 49*c* of the at least one sidewall 40 of the applying member 38 has a flared oval shape. The transverse cross-section of the concave central portion 40*b* is oval or elliptical (not shown).

According to an aspect of the present disclosure, the transverse cross-section of the applying member 38 varies along the length direction. The applying member 38 has non-circular and rounded transverse cross-sections along a major portion of its length. More particularly, the applying member 38 has non-circular and rounded transverse cross-sections along the distal portion 40*c* and the concave central portion 40*b* of the at least one sidewall 40.

The applying member 38 is thus not rotationally symmetric, meaning that the applying member 38 is flattened, particularly the distal portion 40*c*, the concave central portion 40*b* are flattened.

Figure 16:
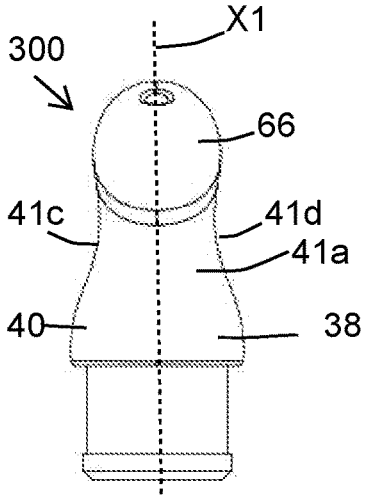
FIG. 16 illustrates a front view of the applicator head of FIG. 15.
Figure 18:
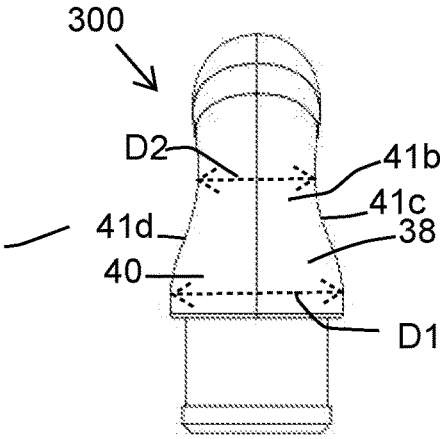
FIG. 18 illustrates a back view of an applicator head of FIG. 15.
Figure 19:
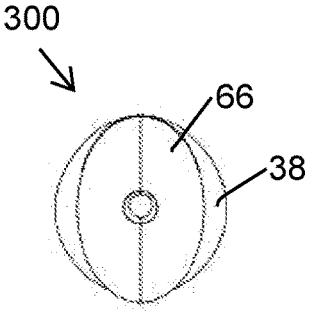
FIG. 19 illustrates a top view of the applicator head of FIG. 15.

Referring to FIGS. 16, 17 and 18, the at least one sidewall 40 of the applying member 38 defines at least four curved faces around the longitudinal axis X1. The four curved faces of the at least one sidewall 40 include a front side face 41*a*, a back side face 41*b*, a left side face 41*c* and a right side face 41*d*. The width of each of the four curved faces 11*a*, 11*b*, 11*c*, 11*d* of the at least one sidewall 9 decreases from the proximal end 34 of the applying member 38 towards the mid-length of the applying member 38 and then increases gradually towards a distal end 33 of the applying member 38, as seen in FIGS. 16-18.

The left side face 41*c* and the right side face 41*d* have the same shape as each other or similar shape to each other, as shown in FIG. 16.

Referring to FIGS. 17-18, the maximum width D1 of each of the front side face 41*a*, the back side face 41*b*, the left side face 41*c* and the right-side face 41*d* is defined at the proximal portion 40*a* of the at least one sidewall 40. The maximum width of each of the front side face 41*a* and the back side face 41*b* is substantially equal to or less than the maximum width of each of the left side face 41*c* and the right-side face 41*d*. The maximum width of each of the front side face 41*a*, the back side face 41*b*, the left side face 41*c* and the right-side face 41*d* is between 9 mm to 11 mm.

As shown in FIGS. 17 and 18, the minimum width of each of the front side face 41*a*, the back side face 41*b*, the left side face 41*c*, and the right-side face 41*d* is defined at the concave central portion 40*b* of the at least one sidewall 40. The minimum width D2 of each of the front side face 41*a* and the back side face 41*b* is lesser than the minimum width D3 of each of the left side face 41*c* and the right side face 41*d*. More particularly, the minimum width D2 of each of the front side face 41*a* and the back side face 41*b* is at least 20% less than the minimum width D3 of each of the left side face 41*c* and the right side face 41*d*. The minimum width D2 of each of the front side face 41*a* and the back side face 41*b* is preferably between 5-8 mm.

The front side face 41*a* has a height less than the height of the back side face 41*b*, as seen in FIG. 17. The height of the front side face 41*a* is at least 60% of the height of the back side face 41*a*. In the exemplary embodiment, the height of the back side face 41*a* is between 15-17 mm.

The distal end face 66 is inclined towards the front side face 41*a*, as seen in FIGS. 15 and 16.

The front side face 41*a* has a concavely curved surface with a first radius of curvature and the back side face 41*b* has another concavely curved surface of the second radius of curvature and wherein the first radius of curvature is shorter than the second radius of curvature, refer FIG. 17.

Further, as seen in FIG. 17, the at least one sidewall 40 of the applying member 38 flares outwards towards the distal end thereof. Because of flaring, a distal endpoint N1 of the front side face 41*a* is furthest away from the longitudinal axis X1 on the front side face 41*a*.

FIG. 18 shows a top view of the applicator head 300. As seen in FIG. 18, the distal end face 66 of the applying member 6 has an elliptical shape.

Figure 20:
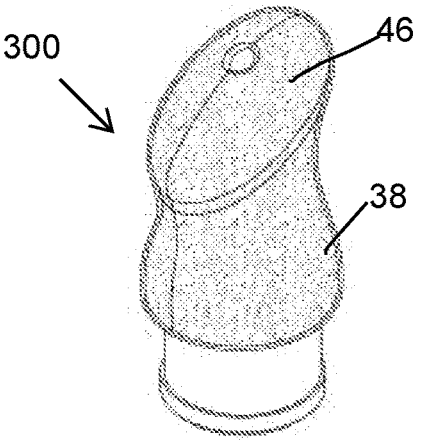
FIG. 20 illustrates a perspective view of the applicator head of FIG. 15 with flocking on an outer surface of an applying member thereof.

FIG. 20 illustrates a perspective view of the applicator head 300 with an outer surface of the applying member 38 flocked with fibers 46.

FIG. 15 illustrates the construction of the applicator head 300. The applicator head 300 includes a shank member 36 which connects the applying member 38 to the receptacle 400 (see FIG. 14). The shank member 36 of the applicator head 300 may be secured to the receptacle 400 by, for example, a press-fit, snap-fit, adhesive, and/or engagement by one or more engagement features.

Referring to FIG. 14, cosmetic package 2 includes a cap 50 to cover the applicator head 300 and protect it from the external atmosphere. The cap 50 may include a pin that extends from an inner surface of the top of the cap 50 and is inserted in the orifice 37 of the applicator head 38 to seal to the orifice 37.

According to an embodiment of the present disclosure, at least a part and preferably all of the applicator head 10, 300 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

In the first embodiment, the wiper 206 serves to wipe off not only the excess cosmetic product attached to the applying member 8 but also the cosmetic product attached to the stem 20.

According to the first embodiment, the receptacles 200, 400 and the caps 30, 50 may be made of a rigid material like glass, metal, hard plastic, or any other material known in the art. However, in alternate embodiments, the receptacles 200, 400 and the cap 30, 50 may be made of a flexible material like flexible polymeric material or any other material known in the art.

According to the first embodiment of the present disclosure, the stem 20 presents a circular cross-section, but it is not beyond the ambit of the present disclosure for this to be otherwise, in particular when the cross-section of the stem 20 is oval, elliptical, or polygonal, e.g. square, triangular or rectangular. The stem 20 can be solid as shown, or, in a variant, it could be hollow.

When the stem 20 is not of circular cross-section, the cap 30 can be fastened on the receptacle 200 by snap-fastening or by some other means, without turning relative to said receptacle 200. The wiper 206 can thus present a non-circular wiper orifice 215 of the section that is complementary to the section of the stem 20.

According to an embodiment of the present disclosure, the applicator head 10 can be made, at least in part, from a material that is more flexible than the material from which the stem 20 is made.

According to the first embodiment of the present disclosure, the applicator head 10 and the stem 20 are fitted together by a snap fitment. However, in alternate embodiments, the applicator head 10 and the stem 20 may be fit together by friction fit, gluing, crimping, magnetic engagement, and the like.

According to the first embodiment of the present disclosure, the stem 20 can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. An applicator head for applying a cosmetic or a care product, the applicator head comprises:

an applying member elongated along a longitudinal axis;

a shank member at a proximal end of the applying member;

wherein the applying member includes a distal end face and at least one sidewall extending from the proximal end of the applying member to a peripheral edge of the distal end face;

wherein the distal end face of the applying member is an inclined and convex surface;

wherein the distal end face makes a non-zero angle with the longitudinal axis of the applying member;

wherein the non-zero angle is in the range between 30° and 75°;

wherein the at least one sidewall of the applying member includes a proximal portion adjacent to the shank member, a distal portion, and a concave central portion extending between the distal portion and the proximal portion;

wherein the proximal portion of the at least one sidewall is configured to be spherical or cylindrical;

wherein the distal portion of the at least one sidewall of the applying member has a flared oval shape;

wherein the proximal portion of the at least one sidewall has transverse cross-sections that are circular;

wherein the distal portion and the concave central portion of the at least one sidewall have rounded transverse cross-sections that are oval or elliptical;

wherein each of the transverse cross-sections of the applying member at the distal portion and the concave central portion has a major axis and a minor axis, wherein the length of the major axes of the transverse cross-sections increases gradually from a mid-length of the applying member towards the distal end face of the applying member;

wherein the at least one sidewall includes a front side face, a back side face, a left side face, and a right side face;

wherein the left side face and the right side face are symmetrical relative to a mid-plane comprising the longitudinal axis of the applying member;

wherein a maximum width of each of the front side face and the back side face is defined at the proximal portion of the at least one sidewall;

wherein a maximum width of each of the left-side face and the right-side face is defined at the distal portion of the at least one sidewall that is spaced from the distal end of the applying member;

wherein a width of the distal portion at each of the left side face and the right side is 30% more than a corresponding width of the distal portion at each of the front side face and the back side face;

wherein a minimum width of each of the front side face, the back side face, the left side face, and the right side face is defined at the concave central portion of the at least one sidewall;

wherein the minimum width of each of the front side face and the back side face is at least 30% less than the minimum width of each of the left side face and the right side face; and wherein the distal end face has an ellipse shape.

2. The applicator head according to claim 1, wherein the distal end face extends along at least 20% of a length of the applying member and at most 40% of the length of the applying member; and wherein a surface area of the distal end face is smaller than a surface area of each of the front side face, the backside face, the left side face, and the right side face.

3. The applicator head according to claim 1, wherein the at least one sidewall comprising the front side face, the back side face, the left side face, and the right side face include a convexly curved surface followed by a concavely curved surface when the applying member is seen along the proximal end to a distal end thereof.

4. The applicator head according to claim 3, wherein the concavely curved surface of the at least one sidewall of the applying member has an extremum depth at half a length of the applying member at the concave central portion of the at least one sidewall.

5. The applicator head according to claim 3, wherein the convexly curved surface of the at least one sidewall of the applying member defines an extremum at substantially about one-fourth of the length of the applying member at the proximal portion of the at least one sidewall.

6. The applicator head according to claim 3, wherein the concavely curved surface of the front side face has a first radius of curvature and the concavely curved surface of the back side face has a second radius of curvature; and wherein the first radius of curvature is shorter than the second radius of curvature.

7. The applicator head according to claim 1, wherein the distal end face of the applying member is inclined towards the front side face.

8. The applicator head according to claim 1, wherein the maximum width of each of the front side face and the back side face is between 5-7 mm and wherein the maximum width of each of the left side face and the right-side face is between 5-8 mm.

9. The applicator head according to claim 1, wherein the minimum width of the front side face and the back side face is between 3-5 mm; and wherein the minimum width of the left side face and the right side face is between 5-6 mm.

10. The applicator head according to claim 1, wherein the front side face has a height less than the height of the back side face; and wherein the height of the front side face is at least 60% of the height of the back side face.

11. The applicator head according to claim 10, wherein the height of the back side face is between 13-16 mm.

12. The applicator head according to claim 1, wherein the distal end face of the applying member has a maximum width between 5-7 mm and a length between 7-10 mm.

13. The applicator head according to claim 1, wherein the at least one sidewall of the applying member flares outwards towards the distal end thereof; wherein a distal endpoint of the front side face is furthest away from the longitudinal axis of the applying member on the front side face; and wherein another distal endpoint on the back side face is furthest away from the longitudinal axis on the back side face.

14. The applicator head according to claim 1, wherein an outer surface of the applying member is covered with fibers.

15. The applicator head according to claim 1, wherein the applicator head is retained at a distal end of a stem; wherein a cap is secured at a proximal end of the stem; and wherein the cap has threads that are configured to be screwed onto threads formed on a neck of a receptacle.

16. An applicator head for applying a cosmetic or a care product, the applicator head comprises:

an applying member elongated along a longitudinal axis;

a shank member at a proximal end of the applying member;

wherein the applying member includes a distal end face and at least one sidewall extending from the proximal end of the applying member to a peripheral edge of the distal end face;

wherein the distal end face of the applying member is an inclined and convex surface;

wherein the at least one sidewall of the applying member includes a proximal portion adjacent to the shank member, a distal portion, and a concave central portion extending between the distal portion and the proximal portion;

wherein the proximal portion is configured to be spherical or cylindrical;

wherein the distal portion has a flared oval shape;

wherein the proximal portion has transverse cross-sections that are circular;

wherein the distal portion and the concave central portion have rounded transverse cross-sections that are oval or elliptical;

wherein each of the transverse cross-sections at the distal portion and the concave central portion has a major axis and a minor axis, wherein the length of the major axes of the transverse cross-sections increases gradually from a mid-length of the applying member towards the distal end face of the applying member;

wherein the at least one sidewall includes a front side face, a back side face, a left side face, and a right side face;

wherein the left side face and the right side face are symmetrical relative to a mid-plane comprising the longitudinal axis of the applying member;

wherein a width of the distal portion at each of the left side face and the right side face is 30% more than a corresponding width of the distal portion at each of the front side face and the back side face;

wherein a minimum width of each of the front side face, the back side face, the left side face, and the right side face is defined at the concave central portion;

wherein the minimum width of each of the front side face and the back side face is at least 20% less than the minimum width of each of the left side face and the right side face;

wherein the distal end face has an ellipse shape;

wherein a surface area of the distal end face is at least 10% smaller than a surface area of the front side face; and wherein a surface area of the distal end face at least 20% smaller than the surface area of each of the backside face, the left side face, and the right side face.

17. The applicator head according to claim 16, wherein applicator head comprises an internal product delivery passageway that terminates in at least one orifice on a distal end face of the applying member; wherein the applicator head is mounted on an opening of a receptacle; and wherein the distal end face makes a non-zero angle in the range between 30° and 75° with the longitudinal axis of the applying member.

18. The cosmetic applicator as claimed in claim 17, wherein a maximum width of each of the front side face, the back side face, the left side face, and the right-side face is between 9 mm to 11 mm; wherein the minimum width of each of the front side face and the back side face is between 5-8 mm; and wherein a height of the back side face is between 15-17 mm.

19. The cosmetic applicator as claimed in claim 16, wherein the at least one sidewall of the applying member flares outwards towards the distal end thereof; and a distal endpoint of the front side face is furthest away from the longitudinal axis on the front side face; and wherein the length of the distal portion at the front side face is at least 60% less than the length of the distal portion at the back side face; and wherein an outer surface of the applying member flocked with fibers.

20. An applicator head for applying a cosmetic or a care product, the applicator head comprising:

an applying member elongated along a longitudinal axis;

a shank member at a proximal end of the applying member;

wherein the applying member includes a distal end face and at least one sidewall extending from the proximal end of the applying member to a peripheral edge of the distal end face;

wherein the distal end face of the applying member is an inclined surface;

wherein the at least one sidewall of the applying member includes a proximal portion adjacent to the shank member, a distal portion, and a concave central portion extending between the distal portion and the proximal portion;

wherein the proximal portion is configured to be spherical or cylindrical;

wherein the distal portion has a flared oval shape;

wherein the at least one sidewall includes a front side face, a back side face, a left side face, and a right side face;

wherein the left side face and the right side face are symmetrical relative to a mid-plane comprising the longitudinal axis of the applying member;

wherein the distal portion and the concave central portion of each of the back side face and the front side face are at least 20% narrower than the distal portion and the concave central portion of each of the left side face and the right side face;

wherein a minimum width of each of the front side face, the back side face, the left side face, and the right side face is defined at the concave central portion;

wherein the distal end face has an ellipse shape;

wherein a surface area of the distal end face is smaller than a surface area of each of the front side face, the backside face, the left side face, and the right side face;

wherein the front side face has a height less than the height of the back side face; and wherein the height of the front side face is at least 60% of the height of the back side face.

* * * * *